US008487965B2

(12) United States Patent
Song et al.

(10) Patent No.: US 8,487,965 B2
(45) Date of Patent: Jul. 16, 2013

(54) DISPLAY DEVICE AND DRIVING METHOD THEREOF

(75) Inventors: Seock-Cheon Song, Suwon-si (KR); Jun-Young Lee, Yongin-si (KR); Myung-Koo Kang, Seoul (KR); Sung-Wook Kang, Seoul (KR); Jong-Hwa Park, Seoul (KR); Young-Kwang Kim, Yongin-si (KR)

(73) Assignee: Samsung Display Co., Ltd. (KR)

( * ) Notice: Subject to any disclaimer, the term of this patent is extended or adjusted under 35 U.S.C. 154(b) by 1215 days.

(21) Appl. No.: 11/932,622

(22) Filed: Oct. 31, 2007

(65) Prior Publication Data

US 2008/0297440 A1 Dec. 4, 2008

(30) Foreign Application Priority Data

Jan. 6, 2007 (KR) ..... 10-2007-0001816

(51) Int. Cl.
*G09G 5/10* (2006.01)

(52) U.S. Cl.
USPC ..... 345/690; 345/204; 345/87; 345/55; 345/696; 345/691

(58) Field of Classification Search
USPC ..... 345/55, 204, 87
See application file for complete search history.

(56) References Cited

U.S. PATENT DOCUMENTS

| | | | | |
|---|---|---|---|---|
| 7,808,493 | B2 * | 10/2010 | Hashimoto et al. | 345/204 |
| 7,859,504 | B2 * | 12/2010 | Furihata et al. | 345/98 |
| 2005/0140633 | A1 * | 6/2005 | Kato | 345/96 |
| 2005/0219162 | A1 | 10/2005 | Tsuge | |

FOREIGN PATENT DOCUMENTS

| | | | |
|---|---|---|---|
| CN | 1622176 | A | 6/2005 |
| CN | 1773593 | A | 5/2006 |
| CN | 1776793 | A | 5/2006 |
| JP | 2001166277 | | 6/2001 |
| JP | 2003-058119 | | 2/2003 |
| JP | 2004045967 | | 2/2004 |
| JP | 2005-141169 | | 2/2005 |
| JP | 2005195703 | | 7/2005 |
| JP | 2005-292387 | | 10/2005 |
| JP | 2005-300977 | | 10/2005 |
| JP | 2006-267525 | | 5/2006 |
| JP | 2006-119581 | | 11/2006 |
| KR | 1020020055992 | A | 10/2002 |
| KR | 1020030051150 | A | 6/2003 |
| KR | 1020040048519 | A | 10/2004 |
| KR | 1020060076862 | A | 5/2006 |
| KR | 1020060078064 | A | 5/2006 |
| KR | 1020060103082 | A | 9/2006 |
| WO | 2006009038 | | 1/2006 |

* cited by examiner

*Primary Examiner* — Grant Sitta
(74) *Attorney, Agent, or Firm* — Cantor Colburn LLP

(57) ABSTRACT

The display device includes a display panel which includes a plurality of pixels, a gate driver which sequentially applies gate-on voltages to the plurality of pixels for a first period and a data driver which generates data voltages for at least two pixels of the plurality of pixels for the first period, and supplies the data voltages to the two pixels of the plurality of pixels, respectively, wherein an application order of the data voltages applied to the at least two pixels of the plurality of pixels is reversed in two adjacent frames.

7 Claims, 6 Drawing Sheets

DISPLAY DEVICE AND DRIVING METHOD THEREOF

This application claims priority to Korean Patent Application No. 10-2007-0001816, filed on Jan. 6, 2007, and all the benefits accruing therefrom under 35 U.S.C. §119, the contents of which in its entirety are herein incorporated by reference.

BACKGROUND OF THE INVENTION (a) Field of the Invention

The present invention relates to a display device and a driving method thereof, and more particularly, to a display device and a driving method thereof capable of reducing power consumption while maintaining a uniform charging time.

(b) Description of the Related Art

Due to recent demands for a reduction in weight and thickness of personal computers and televisions, for example, a reduction in weight and thickness of a display device is required. Thus, cathode ray tubes ("CRTs") are now being replaced with flat panel display devices.

Examples of the flat panel display devices include a liquid crystal display ("LCD") device, a field emission display ("FED") device, an organic light emitting device ("OLED") and a plasma display device ("PDP"). In general, active flat panel display devices include a plurality of pixels arranged in a matrix, and driving circuits such as a signal controller or a data driver for controlling an operation of the plurality of pixels based on control signals. The flat panel display devices process image information in accordance with the control signals in order to control a luminance of each pixel for displaying images.

The image information is output as digital image signals from the signal controller, and the digital image signals are converted to analog data voltages in a digital-to-analog converter of the data driver which are applied to the plurality of pixels through data lines.

When the number of digital-to-analog converters is the same as the number of the data lines, a size of the driving circuits, such as the data driver, increases, which thereby increases power consumption. In addition, the number of pads and an amount of wiring disposed between the driving circuits and the panel assembly increases, which thereby causes signal deterioration, etc.

However, when the number of digital-to-analog converters is less than the number of data lines, a charging time of the data voltage is different for each pixel.

BRIEF SUMMARY OF THE INVENTION

According to an exemplary embodiment of the present invention, a display device is provided. The display device includes a display panel which includes a plurality of pixels, a gate driver which sequentially applies gate-on voltages with a first period to the plurality of pixels and a data driver which generates data voltages for at least two pixels of the plurality of pixels for the first period, and supplies the data voltages to the at least two pixels of the plurality of pixels, respectively, wherein an application order of the data voltages applied to the at least two pixels of the plurality of pixels is changed for every frame.

The application order of the data voltages for the at least two pixels of the plurality of pixels may be reversed in two adjacent frames.

The application order of the data voltages with respect to the at least two pixels of the plurality of pixels for the first period may be substantially equal in the same frame.

The data driver may apply the data voltages to the at least two pixels of the plurality of pixels by changing a data voltage application start position for the at least two pixels of the plurality of pixels for every frame.

The data voltage application start position of the at least two pixels of the plurality of pixels may be shifted by one pixel of the plurality of pixels for every frame.

The application order of the data voltages with respect to the at least two pixels of the plurality of pixels for the first period may be substantially equal in the same frame.

The data driver may include a latch which stores image signals with respect to the at least two pixels of the plurality of pixels, a first selection unit which outputs the image signals based on a first selection signal, a digital-to-analog converter which converts the image signals to the data voltages and a second selection unit which outputs the data voltages to the at least two pixels of the plurality of pixels based on a second selection signal.

The latch may include a plurality of latch circuits, wherein each of the latch circuits of the plurality of latch circuits stores the image signal for each pixel of the plurality of pixels.

The first selection unit may include a plurality of the first switching elements connected to the latch circuits and the digital-to-analog converter, respectively, and the second selection unit includes a plurality of the second switching elements connected to the digital-to-analog converter and the at least two pixels of the plurality of pixels, respectively.

The first switching elements and the second switching elements may be turned on in the same order.

The second selection unit may be positioned on the display panel.

According to another exemplary embodiment of the present invention, a driving method of a display device is provided. The driving method includes receiving image signals for at least two pixels for about one horizontal period to store them and storing the image signals, outputting the stored image signals by varying an output order for every frame, converting the output image signals to data voltages and applying the data voltages to the at least two pixels in the same order as the output order of the image signals.

The application of the data voltages may sequentially apply the data voltages to the at least two pixels for the one horizontal period, and an application order of the data voltages for the at least two pixels is reversed in two adjacent frames.

The application of the data voltages may include applying the data voltages to the at least two pixels in the same order for one horizontal period in the same frame.

The application of the data voltages may include applying to the data voltages to the at least two pixels by changing a data voltage application start position for the at least two pixels for every frame.

The application of the data voltages may include applying the data voltages to the at least two pixels by shifting by one pixel of the at least two pixels for every frame.

The application of the data voltages may include applying the data voltages to the at least two pixels in the same order for one horizontal period in the same frame.

BRIEF DESCRIPTION OF THE DRAWINGS

The above and other aspects, features and advantages of the present invention will become more apparent by describing exemplary embodiments thereof in more detail with reference to the accompanying drawings, in which.

DETAILED DESCRIPTION OF THE INVENTION

Figure 1:
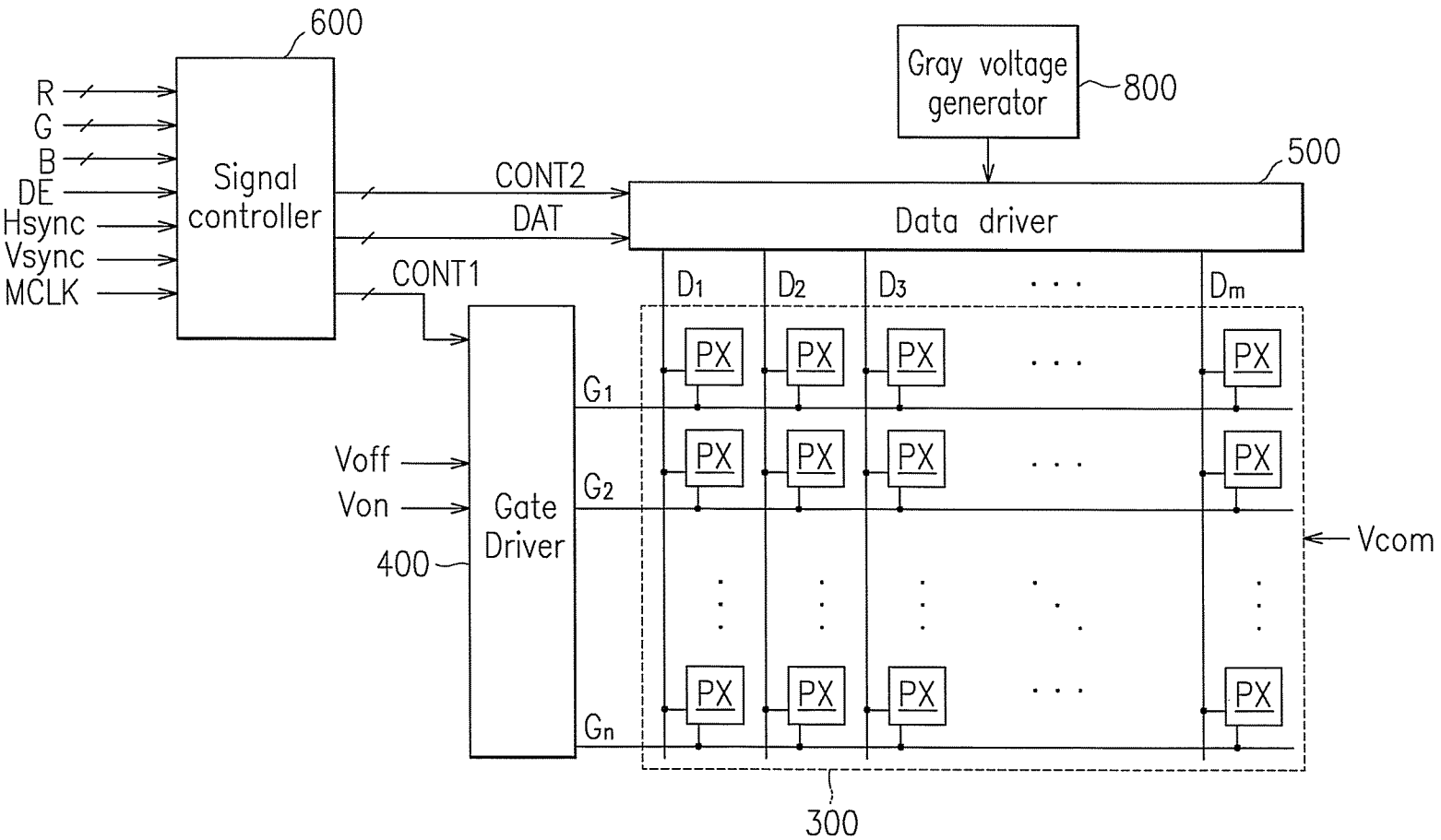
FIG. 1 is a schematic block diagram of an exemplary embodiment of a liquid crystal display ("LCD") according to the present invention.

The invention will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc., may be used herein to describe various elements, components, regions, layers, and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the invention. As used herein, the singular forms "a", "an", and "the" are intended to include the plural forms as well, unless the context clearly indicates otherwise. It will be further understood that the terms "comprises" and/or "comprising", or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation depicted in the figures. For example, when the device in one of the figures is turned over, elements described as being on the "lower" side of other elements would then be oriented on the "upper" side of the other elements. The exemplary term "lower" can therefore encompass both an orientation of "lower" and "upper," depending of the particular orientation of the figure. Similarly, when the device in one of the figures is turned over, elements described as "below" or "beneath" other elements would then be oriented "above" the other elements. The exemplary terms "below" or "beneath" can therefore encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention are described herein with reference to cross-sectional illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

Hereinafter, an exemplary LCD will now be described with reference to FIGS. 1 and 2.

Figure 2:
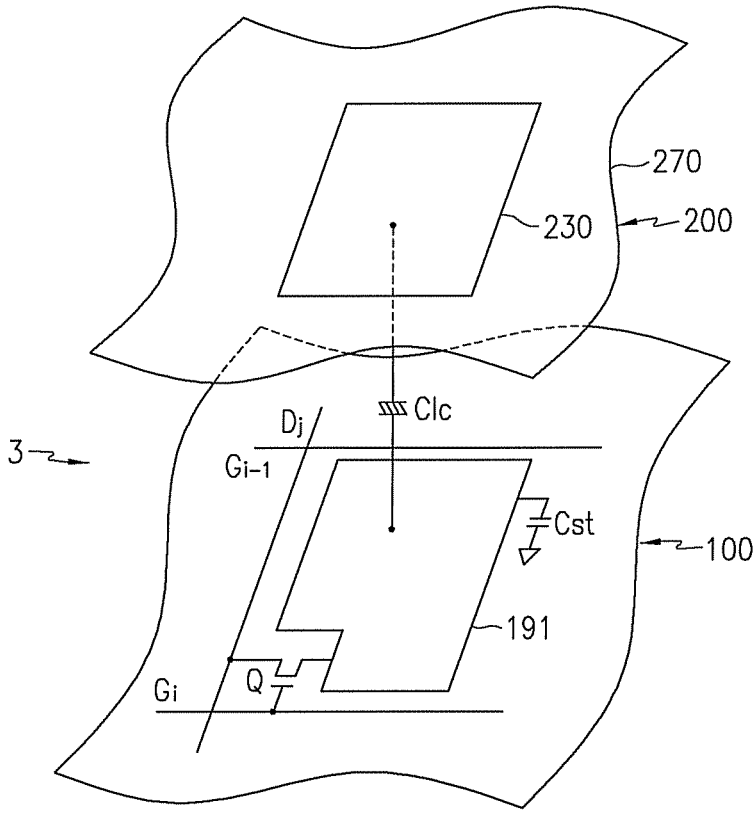
FIG. 2 is an equivalent circuit schematic diagram of an exemplary pixel of an exemplary LCD according to the present invention.

FIG. 1 is a schematic block diagram of an exemplary embodiment of an LCD according to the present invention, and FIG. 2 is an equivalent circuit schematic diagram of an exemplary pixel of an exemplary LCD according to the present invention.

Referring to FIG. 1, an exemplary LCD according to the present invention includes a liquid crystal ("LC") panel assembly 300, a gate driver 400 and a data driver 500 which are coupled with the panel assembly 300, a gray voltage generator 800 coupled with the data driver 500 and a signal controller 600 which controls the above mentioned elements.

The panel assembly 300 includes a plurality of signal lines $G_1$-$G_n$ and $D_1$-$D_m$ and a plurality of pixels PX connected to the signal lines $G_1$-$G_n$ and $D_1$-$D_m$ and arranged substantially in a matrix. In a structural view illustrated in FIG. 2, the panel assembly 300 includes a lower panel 100 and an upper panel 200 which face each other and an LC layer 3 disposed between the lower panel 100 and the upper panel 200.

The signal lines include a plurality of gate lines $G_1$-$G_n$ transmitting gate signals (also referred to as "scanning signals" hereinafter) and a plurality of data lines $D_1$-$D_m$ transmitting data voltages. The gate lines $G_1$-$G_n$ extend substantially in a first direction, such as a row direction, and substantially parallel to each other, while the data lines $D_1$-$D_m$ extend substantially in a second direction, such as a column direction, and substantially parallel to each other. The first direction may be substantially perpendicular to the second direction.

Referring to FIG. 2, in an exemplary embodiment, each pixel PX, for example a pixel PX connected to an i-th gate line $G_i$ (i=1, 2, . . . , n) and a j-th data line $D_j$ (j=1, 2, . . . , m), includes a switching element Q connected to the signal lines $G_i$ and $D_j$, and an LC capacitor Clc and a storage capacitor Cst which are connected to the switching element Q. In alternative exemplary embodiments, the storage capacitor Cst may be omitted.

The switching element Q, which is disposed on the lower panel 100, is a thin film transistor ("TFT") including three terminals, a control terminal, such as a gate electrode, connected to the gate line $G_i$, an input terminal, such as a source electrode, connected to the data line $D_j$ and an output terminal, such as a drain electrode, connected to the LC capacitor Clc and the storage capacitor Cst. In exemplary embodiments, the TFT may include polysilicon or amorphous silicon ("a-Si").

The LC capacitor Clc includes a pixel electrode 191, as a first terminal, disposed on the lower panel 100 and a common electrode 270, as a second terminal, disposed on the upper panel 200. The LC layer 3 disposed between the pixel electrode 191 and the common electrode 270 functions as a dielectric of the LC capacitor Clc. The pixel electrode 191 is connected to the switching element Q, and the common electrode 270 is supplied with a common voltage Vcom and covers an entire surface, or substantially an entire surface, of the upper panel 200. In exemplary embodiments, the common electrode 270 may be provided on the lower panel 100, and at least one of the pixel and common electrodes 191 and 270, respectively, may include a shape of a bar or a stripe.

The storage capacitor Cst is an auxiliary capacitor for the LC capacitor Clc. The storage capacitor Cst includes the pixel electrode 191 and a separate signal line, which is provided on the lower panel 100, overlaps the pixel electrode 191 via an insulator and is supplied with a predetermined voltage such as the common voltage Vcom. In alternative exemplary embodiments, the storage capacitor Cst includes the pixel electrode 191 and an adjacent gate line called a previous gate line, which overlaps the pixel electrode 191 via an insulator.

For a color display, each pixel uniquely represents one of primary colors (e.g., spatial division) or each pixel sequentially represents the primary colors in turn (e.g., temporal division) such that a spatial or temporal sum of the primary colors is recognized as a desired color. In an exemplary embodiment, a set of the primary colors includes red, green and blue. FIG. 2 illustrates an exemplary embodiment of the spatial division in which each pixel includes a color filter 230 representing one of the primary colors in an area of the upper panel 200 facing the pixel electrode 191. In alternative exemplary embodiments, the color filter 230 is provided on or under the pixel electrode 191 on the lower panel 100.

In exemplary embodiments, one or more polarizers (not shown) are attached to the panel assembly 300.

Referring to FIG. 1 again, the gray voltage generator 800 generates a full number of gray voltages or a limited number of gray voltages (referred to as "reference gray voltages" hereinafter) related to a transmittance of the pixels PX. Some of the (reference) gray voltages include a positive polarity relative to the common voltage Vcom, while other (reference) gray voltages include a negative polarity relative to the common voltage Vcom. In exemplary embodiments, the number of total gray voltages with the negative polarity or the positive polarity may be the same as the number of grays represented by the LCD.

The gate driver 400 is connected to the gate lines $G_1$-$G_n$ of the panel assembly 300 and synthesizes a gate-on voltage Von and a gate-off voltage Voff in order to generate the gate signals, which are then applied to the gate lines $G_1$-$G_n$.

The data driver 500 is connected to the data lines $D_1$-$D_m$ of the panel assembly 300 and applies data voltages, which are selected from the gray voltages supplied from the gray voltage generator 800, to the data lines $D_1$-$D_m$. However, when the gray voltage generator 800 generates only a few of the reference gray voltages rather than all of the gray voltages, the data driver 500 may divide the reference gray voltages to generate the data voltages from among the reference gray voltages. A detailed construction of the data driver 500 will be described in further detail below.

The signal controller 600 controls the gate driver 400 and the data driver 500, etc.

In exemplary embodiments, at least one of the driving devices 400, 500, 600 and 800 may be integrated into the panel assembly 300 along with the signal lines $G_1$-$G_n$ and $D_1$-$D_m$ and the switching elements Q. In alternative exemplary embodiments, each of driving devices 400, 500, 600 and 800 may include at least one integrated circuit ("IC") chip mounted on the LC panel assembly 300 or on a flexible printed circuit ("FPC") film in a tape carrier package ("TCP") type, which are attached to the panel assembly 300. In further alternative exemplary embodiments, all of the driving devices 400, 500, 600 and 800 may be integrated into a single IC chip, but at least one of the driving devices 400, 500, 600 and 800 or at least one circuit element in at least one of the driving devices 400, 500, 600 and 800 may be disposed outside of the single IC chip.

Now, an exemplary operation of the above-described exemplary LCD will be described in more detail.

The signal controller 600 is supplied with input image signals R, G and B and input control signals for controlling the display thereof from an external graphics controller (not shown). The input image signals R, G and B contain luminance information of the pixels PX, and the luminance includes a predetermined number of grays, for example 1024 ($=2^{10}$), 256 ($=2^8$), or 64 ($=2^6$) grays. The input control signals include a vertical synchronization signal Vsync, a horizontal synchronization signal Hsync, a main clock signal MCLK and a data enable signal DE.

On the basis of the input control signals and the input image signals R, G and B, the signal controller 600 generates gate control signals CONT1 and data control signals CONT2, and the signal controller 600 processes the image signals R, G and B to be suitable for the operation of the panel assembly 300 and the data driver 500. The signal controller 600 sends the gate control signals CONT1 to the gate driver 400 and sends the processed image signals DAT and the data control signals CONT2 to the data driver 500.

The gate control signals CONT1 include a scanning start signal STV which instructs to start scanning and at least one clock signal which controls an output period of the gate-on voltage Von. In exemplary embodiments, the gate control signals CONT1 may include an output enable signal OE which defines a duration of the gate-on voltage Von.

The data control signals CONT2 include a horizontal synchronization start signal STH which informs a start of data transmission for a row of pixels PX, a load signal LOAD which instructs to apply the data voltages to the data lines $D_1$-$D_m$ and a data clock signal HCLK. In exemplary embodiments, the data control signal CONT2 may further include an inversion signal RVS which reverses a polarity of the data voltages (relative to the common voltage Vcom).

Responsive to the data control signals CONT2 from the signal controller 600, the data driver 500 receives a packet of the digital image signals DAT for a row of pixels PX from the signal controller 600, converts the digital image signals DAT into analog data voltages selected from the gray voltages and applies the analog data voltages to the data lines $D_1$-$D_m$.

Referring now to FIGS. 1 and 2, the gate driver 400 applies the gate-on voltage Von to a gate line $G_1$-$G_n$ in response to the gate control signals CONT1 from the signal controller 600, to thereby turn on the switching transistors Q connected thereto. The data voltages applied to the data lines $D_1$-$D_m$ are then supplied to the pixels PX through the activated switching transistors Q.

A voltage difference between a data voltage and the common voltage Vcom applied to a pixel PX is represented as a voltage across the LC capacitor Clc of the pixel PX, which is referred to as a pixel voltage. The LC molecules in the LC capacitor Clc include orientations depending on a magnitude of the pixel voltage, and the molecular orientations determine a polarization of light passing through the LC layer 3. The polarizer(s) converts light polarization to light transmittance such that the pixel PX has a luminance represented by a gray of the data voltage.

By repeating this procedure by a unit of a horizontal period (also referred to as "1H" and is equal to one period of the horizontal synchronization signal Hsync and the data enable signal DE), all of the gate lines $G_1$-$G_n$ are sequentially supplied with the gate-on voltage Von, thereby applying the data voltages to all of the pixels PX in order to display an image for a frame.

When a next frame starts after one frame finishes, the inversion signal RVS applied to the data driver 500 is controlled such that the polarity of the data voltages is reversed (which is referred to as "frame inversion"). In exemplary embodiments, the inversion signal RVS may be controlled such that the polarity of the data voltages flowing in a data line are periodically reversed during one frame (for example, row inversion and dot inversion), or the polarity of the data voltages in one packet are reversed (for example, column inversion and dot inversion).

Figure 3:
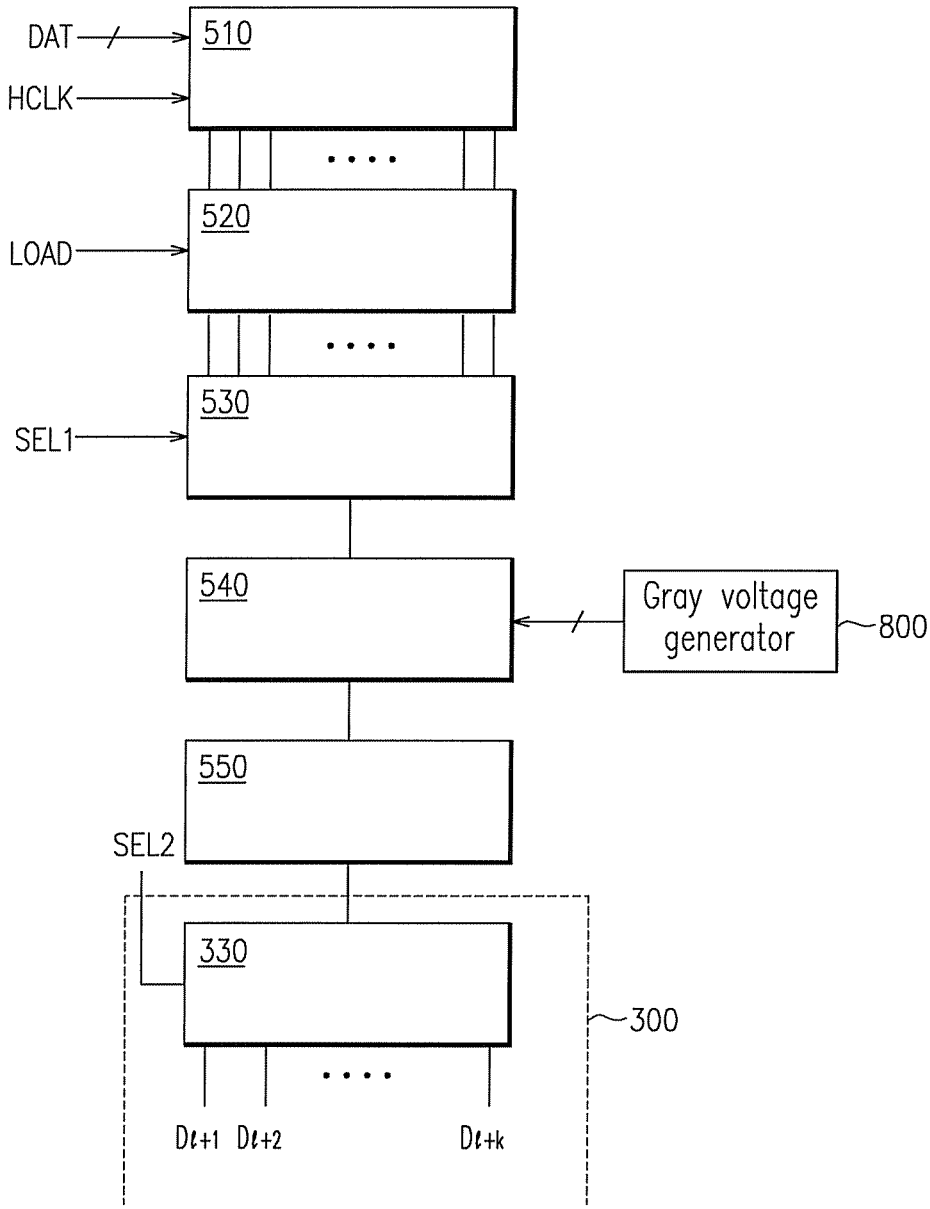
FIG. 3 is a schematic block diagram of an exemplary data driver and an exemplary gray voltage generator of an exemplary LCD according to the present invention.
Figure 4:
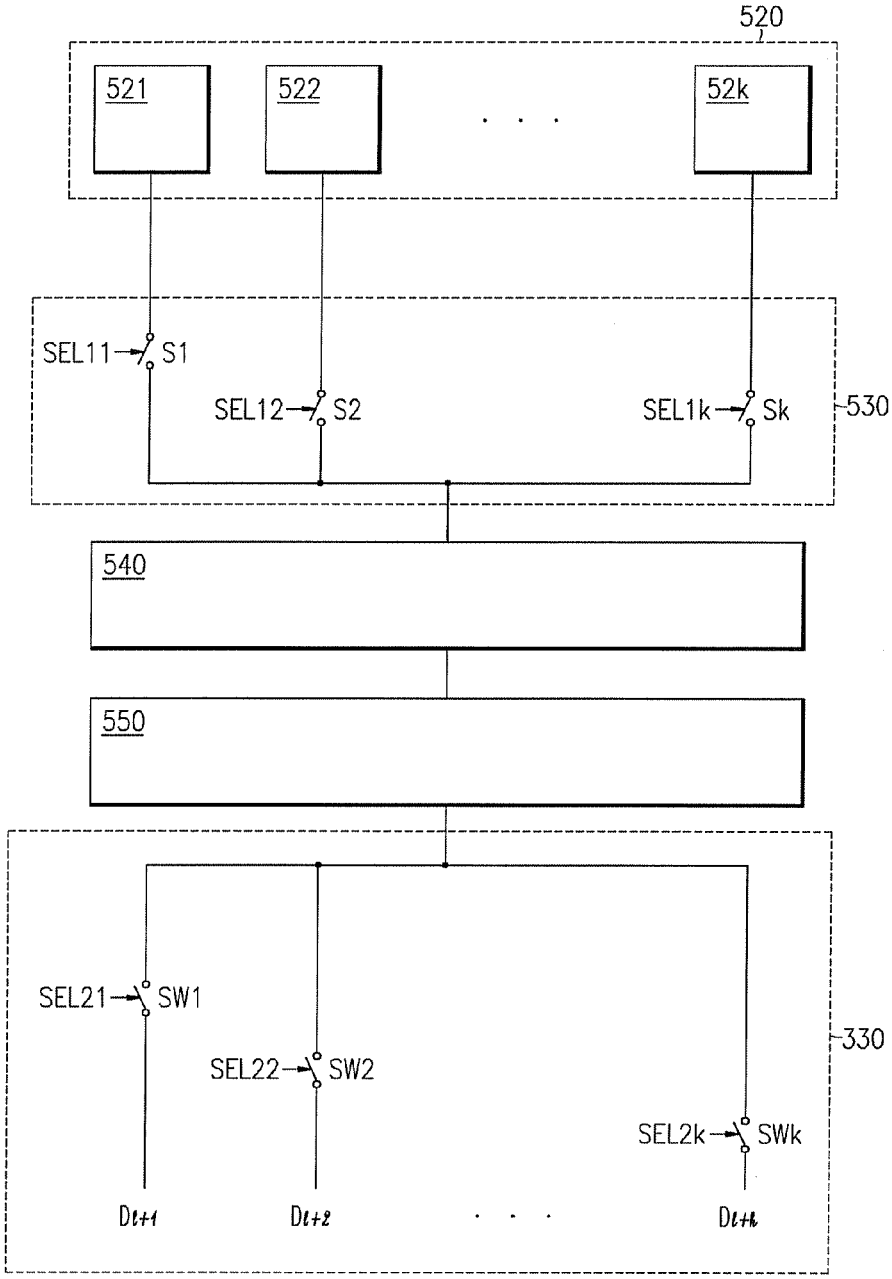
FIG. 4 is detailed schematic block diagram view of the exemplary data driver illustrated in FIG. 3.

Referring to FIGS. 3 and 4, an exemplary data driver 500 according to the present invention will now be described in detail.

FIG. 3 is a schematic block diagram of an exemplary data driver and an exemplary gray voltage generator of an exemplary LCD according to the present invention, and FIG. 4 is a detailed schematic block diagram view of the exemplary data driver illustrated in FIG. 3.

In exemplary embodiments, the data driver 500 may include a plurality of data driving integrated circuits ("ICs") (not shown). Referring to FIG. 3, each of the data driving ICs includes a shift register 510, a latch 520, a first selecting unit 530, a digital-to-analog converter 540, an output buffer 550 and a second selecting unit 330.

When the horizontal synchronization start signal STH (or a shift clock signal) is input, the shift register 510 sequentially shifts the inputted image data DAT by synchronizing the data clock signal HCLK, in order to output the image data DAT to the latch 520.

The latch 520 stores the analog image data DAT, and outputs the stored analog image data DAT to the first selecting unit 530 based on the load signal LOAD.

The first selecting unit 530 sequentially outputs the analog image data DAT corresponding to the pixels PX from the latch 520 to the digital-to-analog converter 540 based on a first selection signal SELL.

The digital-to-analog converter 540 is supplied with the gray voltages from the gray voltage generator 800, and selects gray voltages with a positive polarity or a negative polarity with respect to the common voltage Vcom based on the inversion signal RVS. Then, the digital-to-analog converter 540 selects gray voltages corresponding to digital image data DAT from the gray voltages with the positive polarity or the negative polarity in order to convert the digital image data DAT to analog voltages, and then outputs the analog voltages to the output buffer 550.

The output buffer 550 outputs the analog voltages from the digital-to-analog converter 540 to the second selecting unit 330 as data voltages, and maintains the data voltages constant for a predetermined period such as about 1H.

The second selecting unit 330 applies the data voltages from the output buffer 550 to the data lines $D_{l+1}$-$D_{l+k}$ based on a second selection signal SEL2.

That is, as described above, one data driving IC applies the data voltages to the plurality of data lines $D_{l+1}$-$D_{l+k}$ by a single digital-to-analog converter 540 for about 1H.

A detailed construction of an exemplary data driving IC will now be described in more detail with reference to FIG. 4.

Referring to FIG. 4, when one data driving IC applies data voltages to the "k" number of pixels PX for about 1H, the latch 520 also includes the "k" number of latch circuits 521-52*k*, whereby the number of latch circuits 521-52*k* is equal to the number of the pixels PX.

The latch circuits 521-52*k* receive the digital image signals DAT with respect to the corresponding pixels PX from the shift register 510, and stores them, respectively.

The first selecting unit 530 includes a plurality of switching elements S1-Sk. Each of the switching elements S1-Sk connects between the corresponding latch circuit 521-52*k* and the digital-to-analog converter 540.

The first selection signal SEL1 includes a plurality of first selection signals SEL11-SEL1*k*, each of which is applied to the corresponding switching elements S1-Sk, in order to control the switching elements S1-Sk.

Each of the switching elements S1-Sk is turned on or off based on a state of the corresponding first selection signal SEL11-SEL1*k*, to thereby connect between the corresponding latch circuit 521-52*k* and the digital-to-analog converter 540 or to disconnect therebetween.

The second selection unit 330 includes a plurality of switching elements SW1-SWk. Each of the switching elements SW1-SWk connects between the output buffer 550 and the corresponding data lines $D_{l+1}$-$D_{l+k}$.

The second selection signal SEL2 includes a plurality of second selection signals SEL21-SEL2*k*, each of which is applied to the corresponding switching elements SW1-SWk, in order to control the switching elements SW1-SWk.

Each of the switching elements SW-SWk is turned on or off based on a state of the corresponding second selection signal SEL21-SEL2*k*, in order to control an application of the data voltages to the data lines $D_{l+1}$-$D_{l+k}$.

The number of latch circuits 521-52*k*, switching elements S1-Sk of the first selection unit 530 and switching elements SW1-SWk of the second selection unit 330 is each equal to the number "k", and thereby are the same number as each other.

In exemplary embodiments, the second selection unit 330 may be formed as one IC along with other elements of the data driver 500. In alternative exemplary embodiments, the second selection unit 330 may be integrated into the panel assembly 300 along with the pixels PX. In the current exemplary embodiment, the switching elements SW1-SWk of the second selection unit 330 may be formed as TFTs which are the same as, or substantially similar to, the switching elements Q of the pixels PX.

Next, referring to FIGS. 5 and 6, an exemplary operation of an exemplary LCD including the exemplary data driver 500 illustrated in FIG. 4 will now be described.

Figure 5:
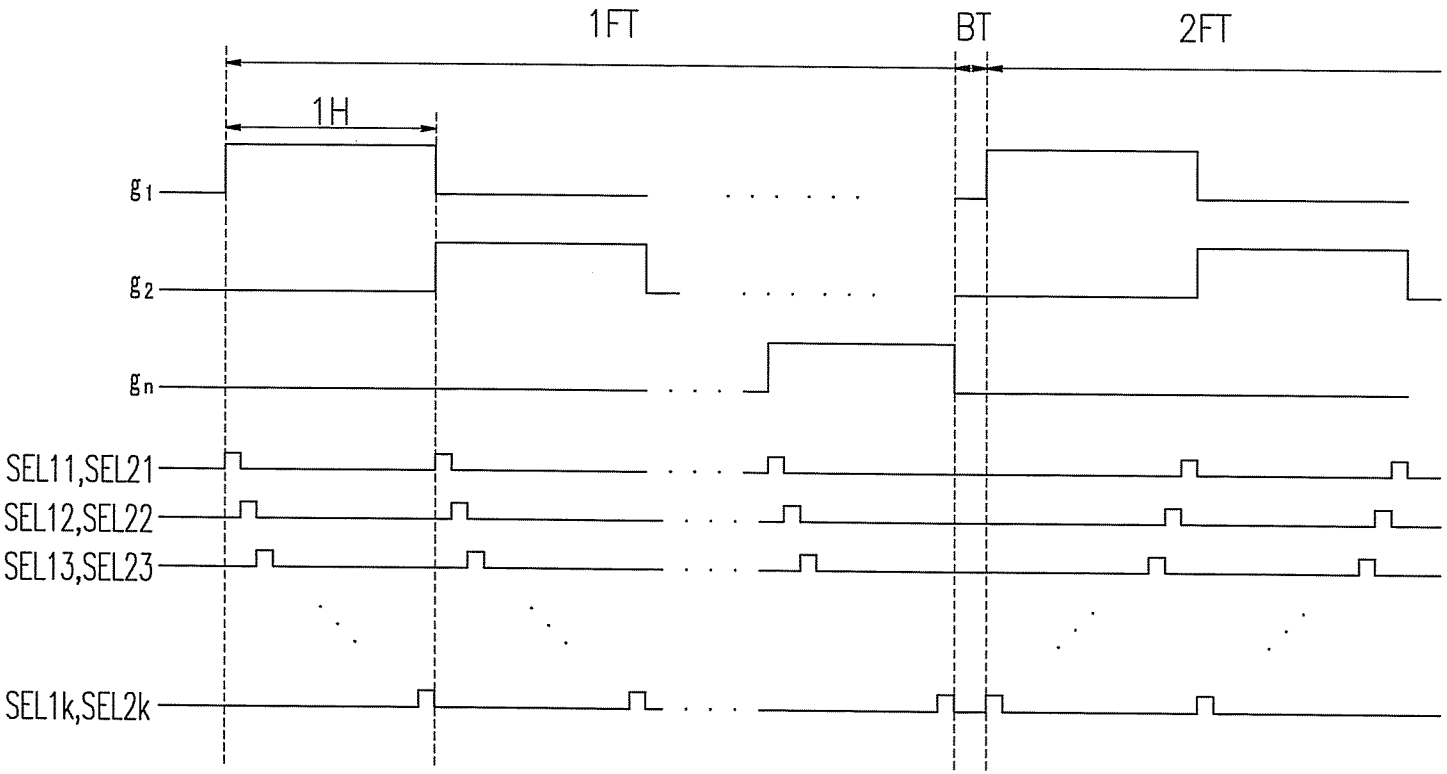
FIG. 5 is a signal waveform diagram illustrating an exemplary operation of an exemplary LCD according to the present invention.
Figure 6:
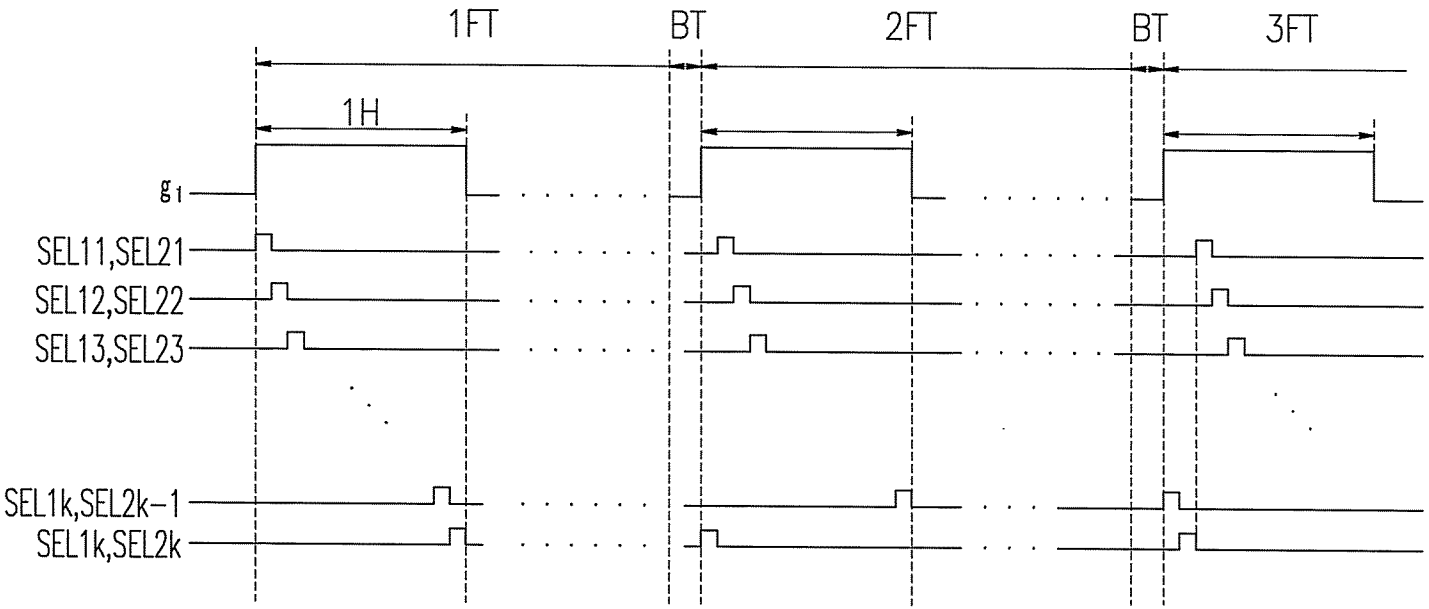
FIG. 6 is a signal waveform diagram illustrating another exemplary operation of an exemplary LCD according to the present invention.

FIG. 5 is a signal waveform illustrating an exemplary operation of an exemplary LCD according to the present invention, and FIG. 6 is a signal waveform illustrating another exemplary operation of an exemplary LCD according to the present invention.

All of the data driving ICs perform the same operation, and thereby an operation of one data driving IC applying data voltages to the data lines $D_{l+1}$-$D_{l+k}$ will now be described.

Referring to FIG. 5, responsive to the data control signals CONT2 from the signal controller 600, the data driver 500 receives a packet of the digital image signals DAT for a row of pixels PX from the signal controller 600, and the latch circuits 521-52*k* of the data driving IC store the image signals DAT as a bit unit, respectively.

The gate driver 400 applies the gate-on voltage Von to a gate line $G_1$-$G_n$ in response to the gate control signals CONT1 from the signal controller 600, to thereby turn on the switching transistors Q connected thereto.

In order for the gate-on voltage Von to be applied to the corresponding gate line $G_1$-$G_n$, the switching elements S1-Sk of the first selection unit 530 are sequentially turned on, and thereby the latch circuits 521-52*k* are connected to the digital-to-analog converter 540. Thus, the image signals DAT stored on the latch circuits 521-52*k* are sequentially converted to analog data voltages in the digital-to-analog converter 540, and then the converted analog data voltages are transmitted to the second selection unit 330 through the output buffer 550.

At this time, the switching elements SW1-SWk of the second selection unit 330 are sequentially turned on, to thereby sequentially transmit the data voltages to the corresponding data lines $D_{l+1}$-$D_{l+k}$. The turn-on order of the switching elements SW1-SWk is the same or substantially similar as that of the switching elements S1-Sk. Each element of a pair of switching elements S1 and SW1, S2 and SW2, . . . , and Sk and SWk may be simultaneously turned on, respectively.

Hence, in exemplary embodiments, the first and second control signals SEL11-1*k* and SEL21-SEL2*k*, respectively, may be the same signals, and each element of the of the pairs of switching elements S1 and SW1, S2 and SW2, . . . , and Sk and SWk may be turned on or off by the same selection signal.

Therefore, for 1H, the data driving IC sequentially applies the data voltages to one pixel row, and each pixel PX displays an image with respect to the data voltage.

For each 1H of one frame 1FT, the first and second selection units 530 and 330 output the image data DAT and the data voltages in the same order, respectively.

When the gate-off voltage Voff is applied to the last gate line $G_n$ and then one frame finishes, a next frame 2FT starts after a predetermined blanking time BT.

In the next frame 2FT, the latch circuits 521-52*k* store the image signals DAT for one pixel row substantially similar to the previous frame 1FT.

In exemplary embodiments, the first and second selection units 530 and 330, respectively, output the image signals DAT and the data voltages for 1H in a different order from that of the previous frame 1FT, for example, in an opposite order to the previous frame 1FT.

That is, when in the previous frame 1FT, the switching elements S1 and SW1, S2 and SW2, . . . , and Sk and SWk are sequentially turned on from the first switching elements S1 and SW1 to the last switching elements Sk and SWk in order to sequentially apply the data voltages from the first data line $D_{l+1}$ to the last data line $D_{lk}$, and in the next frame 2FT, the switching elements S1 and SW1, S2 and SW2, . . . , and Sk and SWk are sequentially turned on from the last switching elements Sk and SWk to the first switching elements S1 and SW1 in order to sequentially apply the data voltages from the last data line $D_{l+k}$ to the first data line $D_{l+1}$.

As described above, even though the data voltages are sequentially charged in the pixels PX of one row, the charging time of the pixels PX of one row is made uniform since the application order of the data voltages is reversed for every frame.

That is, when a pixel PX is disposed in a first column, a data voltage is applied to the pixel PX for the longest amount of time (e.g., about 1H) in a frame 1FT, however, a data voltage is applied to the same pixel PX for the shortest amount of time in the next frame 2FT. Thereby, the total data voltage application time of all of the pixels PX becomes uniform, and thereby the data charging time of all the pixels PX is made uniform.

In addition, when one pixel PX is supplied with a data voltage by the turning on of the switching element Q, and then the switching elements S1-Sk and SW1-SWk corresponding to the pixel PX are turned off, the data line $D_{l+1}$-$D_{l+k}$ connected to the pixel PX is thereby disconnected from the data driver IC to become in a floating state.

In this state, when the next data line $D_{l+1}$-$D_{l+k}$ is supplied with a data voltage by the turning on of the switching elements S1-Sk and SW1-SWk connected to the next data line $D_{l+1}$-$D_{l+k}$, and then a voltage of the next data line $D_{l+1}$-$D_{l+k}$ is varied, the charged voltage of the pixel PX of the floating state is also varied by a parasitic capacitance between the adjacent data lines $D_{l+1}$-$D_{l+k}$. However, since the data voltage application order is reversed every frame, the variation of the charged voltage is dispersed, in order to decrease image deterioration which is visually recognized.

In an alternative exemplary embodiment, the turn-on start order of the switching elements S1 and SW1, S2 and SW2, . . . , and Sk and SWk is rotated as illustrated in FIG. 6, in order to vary the data voltage application order for about 1H.

That is, when in a frame 1FT, the switching elements S1 and SW1, S2 and SW2, . . . , and Sk and SWk are sequentially turned on in the order from the first switching elements S1 and SW1 to the last switching elements Sk-SWk, in the next frame 2FT, the switching elements S1 and SW1, S2 and SW2, . . . , Sk and SWk are sequentially turned on in the order from the second switching elements S2 and SW2 to the first switching elements S1-SW1.

As illustrated in FIG. 6, when the application start position of the data voltage to the data lines $D_{l+1}$-$D_{l+k}$ is shifted by one frame, the average data voltage charging time of a plurality of pixels PX, for example k number of pixels PX connected to one data driver IC for k number of frames, is made uniform.

While this invention has been described in connection with what is presently considered to be practical exemplary embodiments, it is to be understood that the invention is not limited to the disclosed exemplary embodiments, but, on the contrary, is intended to cover various modifications, changes in form and details and equivalent arrangements included within the spirit and scope of the appended claims.

What is claimed is:

1. A display device comprising:

a display panel which includes a plurality of pixels;

a gate driver which sequentially applies gate-on voltages with a first period to the plurality of pixels; and a data driver which generates data voltages for at least two pixels of the plurality of pixels for the first period, and supplies the data voltages to the at least two pixels of the plurality of pixels, respectively, wherein a data voltage application start position of the at least two pixels of the plurality of pixels for the first period of a frame is right-shifted by one pixel of the plurality of pixels for the first period of a next frame, wherein an application order of the data voltages with respect to the at least two pixels of the plurality of pixels for the first period is repeated in the same frame, and wherein a data voltage application start position of the at least two pixels of the plurality of pixels for the first period is not shifted in a next period of the same frame.

2. The display device of claim 1, wherein the data driver comprises:

a latch which stores image signals with respect to the at least two pixels of the plurality of pixels;

a first selection unit which outputs the image signals based on a first selection signal;

a digital-to-analog converter which converts the image signals to the data voltages; and a second selection unit which outputs the data voltages to the at least two pixels of the plurality of pixels based on a second selection signal.

3. The display device of claim 2, wherein the latch comprises a plurality of latch circuits, wherein each of the latch circuits of the plurality of latch circuits stores the image signal for each pixel of the plurality of pixels.

4. The display device of claim 2, wherein the first selection unit comprises a plurality of the first switching elements connected to the latch circuits and the digital-to-analog converter, respectively, and the second selection unit comprises a plurality of the second switching elements connected to the digital-to-analog converter and the at least two pixels of the plurality of pixels, respectively.

5. The display device of claim 4, wherein the first switching elements and the second switching elements are turned on in the same order.

6. The display device of claim 5, wherein the second selection unit is positioned on the display panel.

7. A driving method of a display device, comprising:

receiving image signals for at least two pixels for about one horizontal period to store them and storing the image signals;

outputting the stored image signals by varying an output order for every frame;

converting the output image signals to data voltages; and applying the data voltages to the at least two pixels in the same order as the output order of the image signals, wherein the application of the data voltages includes applying the data voltages to the at least two pixels by right-shifting an application order of the first period by one pixel of the at least two pixels in an application order of the first period of a next frame, wherein an application of the data voltages includes applying the data voltages to the at least two pixels in the same order for one horizontal period in the same frame, and wherein a data voltage application start position of the at least two pixels of the plurality of pixels for the first period is not shifted in a next period of the same frame.

* * * * *